United States Patent [19]

Colmenero

[11] 4,121,200

[45] Oct. 17, 1978

[54] SWIMMING POOL ALARM SYSTEM

[76] Inventor: Gustavo T. Colmenero, 2624 Walnut La., Plano, Tex. 75074

[21] Appl. No.: 707,670

[22] Filed: Jul. 22, 1976

[51] Int. Cl.[2] ..... G08B 13/16

[52] U.S. Cl. ..... 340/539; 340/8 PC; 340/566

[58] Field of Search ..... 340/3 C, 3 E, 8 R, 8 S, 340/224, 258 D, 261, 8 PC

[56] References Cited

U.S. PATENT DOCUMENTS

| | | | |
|---|---|---|---|
| 1,002,567 | 9/1911 | Davison | 340/8 R |
| 2,832,915 | 4/1958 | McCoy | 340/261 |
| 2,942,247 | 6/1960 | Lienau et al. | 340/258 D |
| 3,273,138 | 9/1966 | Kolm | 340/261 |
| 3,953,843 | 4/1976 | Codina | 340/261 |
| 3,969,712 | 7/1976 | Butman et al. | 340/261 |

*Primary Examiner*—Donald J. Yusko
*Assistant Examiner*—Joseph E. Nowicki
*Attorney, Agent, or Firm*—Hubbard, Thurman, Turner, Tucker & Glaser

[57] ABSTRACT

A swimming pool alarm system for activating an alarm indicator responsive to the presence of a person in a pool being monitored. The system includes a frequency selective detector responsive to water disturbance created by a person in a swimming pool. The detector enables a transmitter at poolside. A receiver remotely mounted with respect to the poolside transmitter responds to the transmissions therefrom activating the alarm indicator.

11 Claims, 4 Drawing Figures

SWIMMING POOL ALARM SYSTEM

BACKGROUND OF THE INVENTION

This invention relates to monitoring and alarm systems and, more particularly, to a system for monitoring a swimming pool and providing an alarm indication in response to an object entering the pool or motion of a person or live animal in the pool.

Recent years have shown a great increase in the number of swimming pool installations, especially those of the backyard variety. These pools often present a safety hazard. For example, a small child unable to swim may play in an area adjacent to a pool. Regardless of the safety precautions that are maintained, instances will arise when play may go unsupervised. It would therefore be desirable to have an apparatus responsive to a child falling into an unattended swimming pool such that a competent person is alerted.

Most public pools are open only during specified hours. During the hours the public pool is closed, it is typically protected by a locked fence. However, in some instances these fences are no obstacle to unscrupulous people desiring to swim while the pool is closed. Again, it would be desirable to provide an apparatus to detect the unauthorized use of the pool.

It is therefore an object of this invention to provide apparatus responsive to presence of a person in a swimming pool to create an alarm indication.

It is further an object of this invention to provide such apparatus which may be readily installed at an existing swimming pool.

It is yet a further object of this invention to provide such apparatus without any wiring that would create an electrical shock hazard or would otherwise allow a person to trip thereover.

It is another object of this invention to provide such apparatus which may be installed without the necessity for any excavation or destruction of existing finished surfaces.

It is still another object of this invention to provide such apparatus wherein a loud audible alarm may be locally sounded to afford quick and immediate response in the event a rescue is necessary.

It is yet another object of this invention to provide such apparatus wherein the alarm indication may be remote from the pool so that proper authorities may prevent destruction or unauthorized use of public facilities.

SUMMARY OF THE INVENTION

The foregoing and additional objects of this invention are attained by providing a water disturbance sensor which generates signals induced by movement of the water. These signals are coupled to a frequency selective signal processor which filters out background noise such as that created by wind, rain and normal poolside traffic but provides an output signal when an object enters the pool or motion such as that created by a person in the swimming pool is present. The output signal from the signal processor enables control of a transmitter which may be located at the position of the signal processor. A remote receiver activates an alarm upon receipt of signals from the transmitter. One of the features of the invention is the provision, as a part of the water displacement sensor, of a water displacement collector positioned below the surface of the water which effectively amplifies changes in water displacement produced by disturbances of the water.

DESCRIPTION OF THE DRAWINGS

The foregoing will be more readily apparent upon reading the following description in conjunction with the drawings in which.

DESCRIPTION OF THE PREFERRED EMBODIMENT

Figure 1:
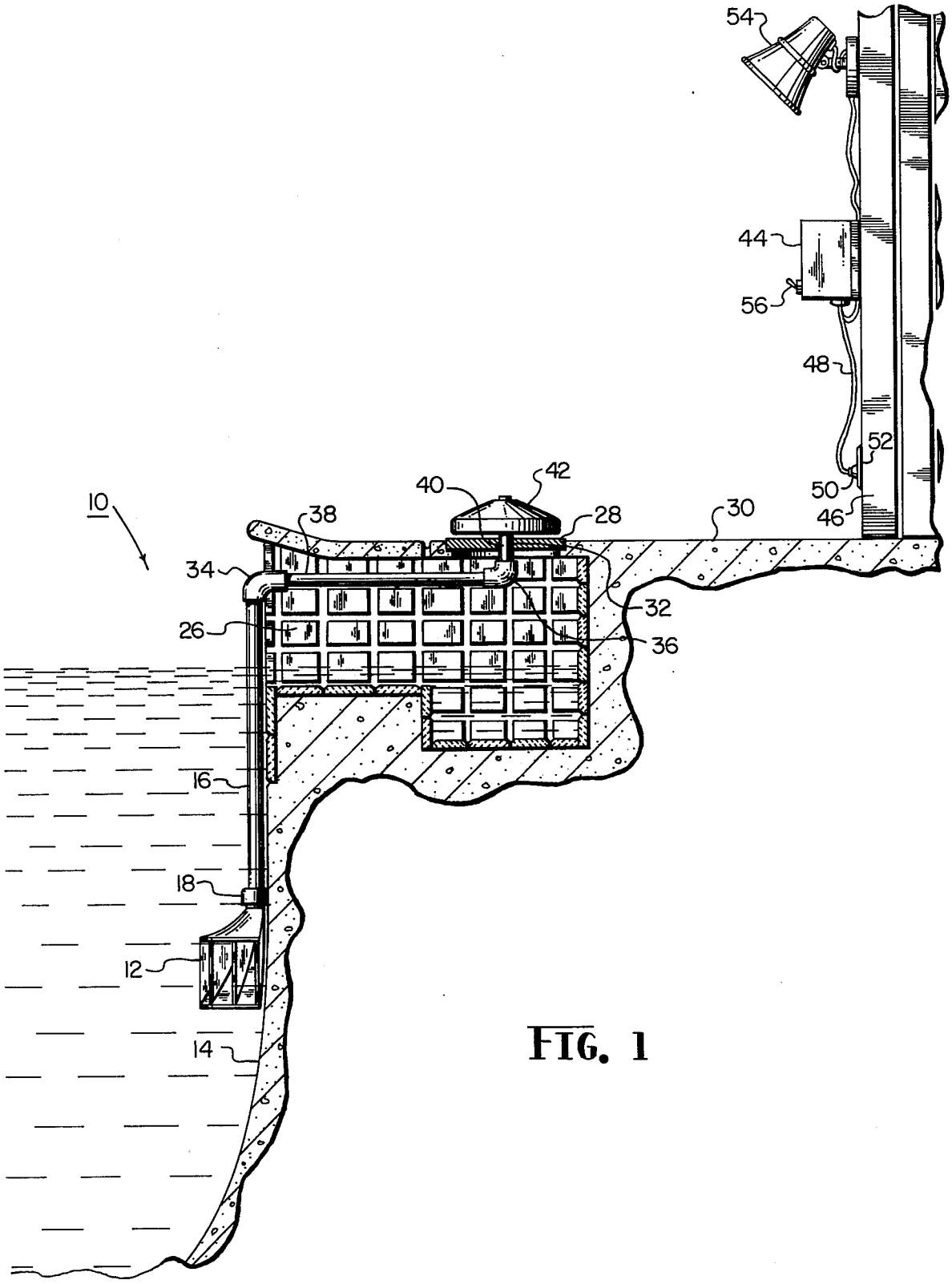
FIG. 1 depicts a swimming pool showing the installation of apparatus in accordance with this invention.
Figure 2:
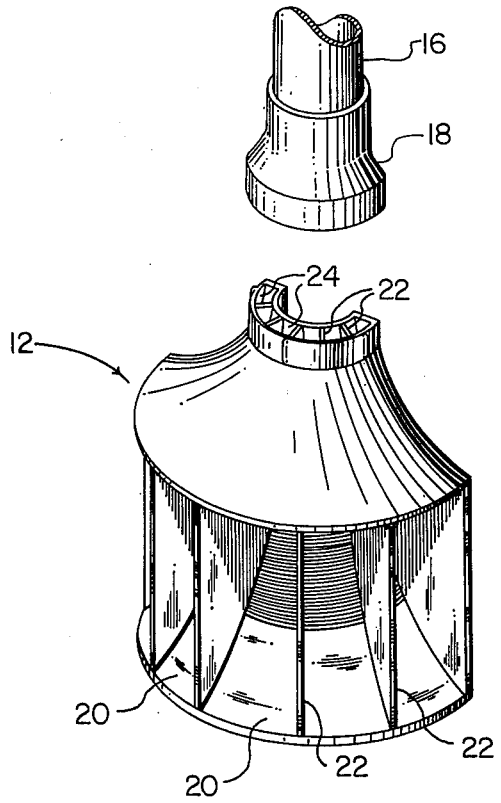
FIG. 2 depicts a perspective view of an illustrative underwater displacement collector.

Referring now to the drawing wherein like reference numerals in different figures indicate like parts, in FIG. 1 there is depicted a swimming pool designated generally by the reference numeral 10 in which apparatus constructed in accordance with the principles of this invention is installed. The apparatus includes an underwater water displacement collector member 12, depicted perspectively in FIG. 2, mounted by suitable means not shown, on the side wall 14 of the pool 10 preferably 18 to 30 inches below the normal pool water level. Collector 12 functions to direct water displacement information into tube 16 connected to collector member 12 through a transition member 18. As shown in FIG. 2, collector member 12 includes a plurality of openings 20 positioned on an arc extending approximately 180° so that receipt of displacement information from any location in the pool optimized. The openings 20 are separated by walls 22 and each of the openings 20 are connected by flared horn like regions 21 to openings 24 collector member 12. Since the openings 20 are much larger than the openings 24, the effect of changes in water displacement is amplified. A hollow transition member 18 connects all the openings 24 to hollow tube 16.

Typically, swimming pool 10 includes at least one pool filter opening 26 in its wall 14. A skimmer lid 28 provides access from the pool deck 30 to pool filter opening 26. The usual skimmer lid 28 has a circular hole 32 in the center of the lid 28 to facilitate removal of the lid 28 from the deck 30. The apparatus according to this invention is designed for easy installation through this hole 32. Hollow tube 16 is coupled, illustratively by means of the elbow fittings 34 and 36 and intermediate tube 38, to a tube 40 extending through hole 32 from the base of housing 42. The connection between elbow 36 and tube 40 is preferably not airtight, whereas all other connections are airtight. Housing 42 contains a transducer for providing electrical signals generated in response to changes in water displacement picked up by collector member 12 and transmitted through tube 16 to create pressure changes in the air column in the tubing above the water level. The slight amount of air leakage at the connection of tube 40 to elbow 36 allows the equalization of pressure at the transducer whenever there is a slowly occurring change resulting from, for example, changes in pool water level or barometric pressure changes.

The electrical signals at the output of the transducer are coupled to a signal processor 62 which is sensitive to signal frequencies characteristic of the disturbance created by a person in the swimming pool and insensitive to frequencies created by other factors such as wind and rain. The signal processor 62 is coupled to enabling circuitry for a transmitter 68 inside housing 42. Housing 42 also contains a battery for powering the circuitry therein. The low profile design of housing 42 is such that it is inconspicuous, rugged to endure the antics of children and adults at poolside, and watertight to provide protection for the parts contained therein.

Remotely located with respect to the transmitter in housing 42 is a receiver 74 which is illustratively enclosed in a housing, or box, 44 mounted on a wall, or fence, 46 within transmitting range of the transmitter in housing 42. The receiver in box 44 is electrically powered via conductor 48 connected to a plug 50 which may be inserted into a standard electrical outlet 52. Alternatively, box 44 may contain a battery for powering the circuitry therein. The receiver in box 44 is coupled to an alarm indicator 54, illustratively depicted as being an electrically operated horn. Alternatively, as will be described in more detail hereinafter, the alarm indicator 54 may take some other form. Also mounted on box 44 is an on/off switch 56 which may be utilized to selectively remove or apply power to the receiver and alarm indicator. For example, when the pool is in use, it is desirable to disable the alarm system whereas when the pool is not supposed to be in use, it is desirable to enable the alarm system.

Figure 3:
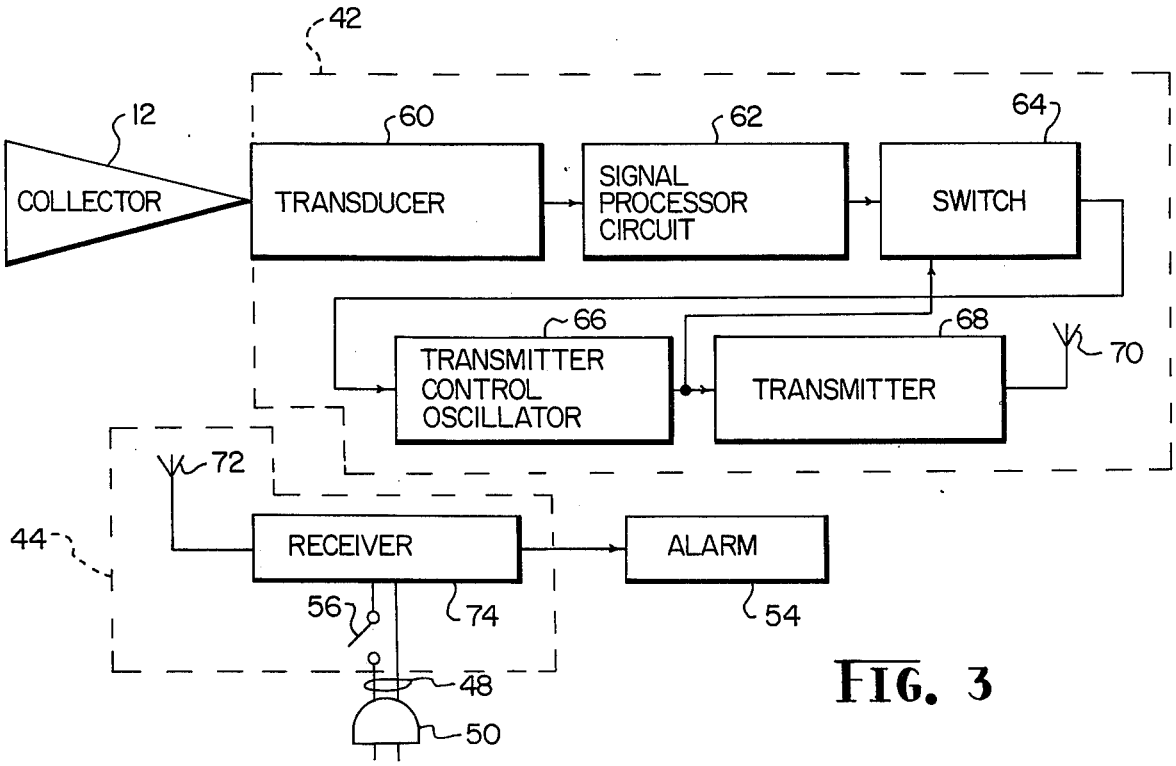
FIG. 3 depicts a block schematic diagram of illustrative circuitry operating in accordance with the principles of this invention.

Referring now to FIG. 3, collector 12 is shown as being coupled to transducer 60. Illustratively, transducer 60 is of ceramic material which is responsive to pressure changes for providing an electrical signal at output conductors coupled across the transducer. This type of transducer element is particularly well adapted for use with the described apparatus because water displacement information transmitted through collector 12 and tube 16 cause air pressure changes in tube 40. The ceramic element 60 is held in place at the upper end of tube 40 within housing 42 to detect those air pressure changes. It has been experimentally determined that a person in a pool, or other body of water, creates a disturbance which is characterized by frequencies in the range of about 0.5 to 5 hertz.

Signal Processor circuit 62 is therefore designed as a band pass filter and amplifier which provides a signal to switch 64 when signals having the desired frequency characteristic are generated at the output of transducer 60. Switch 64 is coupled to transmitter control oscillator 66 which generates signals which are coupled to the input of transmitter 68. Switch 64 and oscillator 66 are designed and interconnected so that transmitter 68 only radiates signals at antenna 70 for intervals of less than one second with intervals of greater than 30 seconds between transmissions. This particular timing is for the purpose of adhering to FCC regulations regarding remote control devices.

The signals radiated from antenna 70 are picked up by antenna 72 in box 44 remotely located with respect to housing 42. The signals picked up by antenna 72 are coupled to receiver 74 which verifies the transmission and responsive thereto activates alarm 54. The combination of transmitter 68 and receiver 74 may be any commercially available combination, such as that utilized in automatic garage door openers, for example, and since the internal workings of such combinations are well known and form no part of the present invention, no detailed description thereof will be given. Alarm 54 may be, for example, a loud horn which is preferable when the afore-described apparatus is installed to monitor a backyard swimming pool. Alternatively, or in addition, alarm 54 may comprise a flashing light. As a further alternative, when the afore-described apparatus is installed to monitor a public swimming pool, alarm 54 may comprise a loud audible horn and in addition, or as a substitute therefor, may comprise an automatic telephone dialer preset to call the local police precinct and may include a recording for informing the police of the alarm situation. It is contemplated that any such alarm device may be utilized with the apparatus according to this invention and this invention is not intended to be limited to any particular form of alarm.

Figure 4:
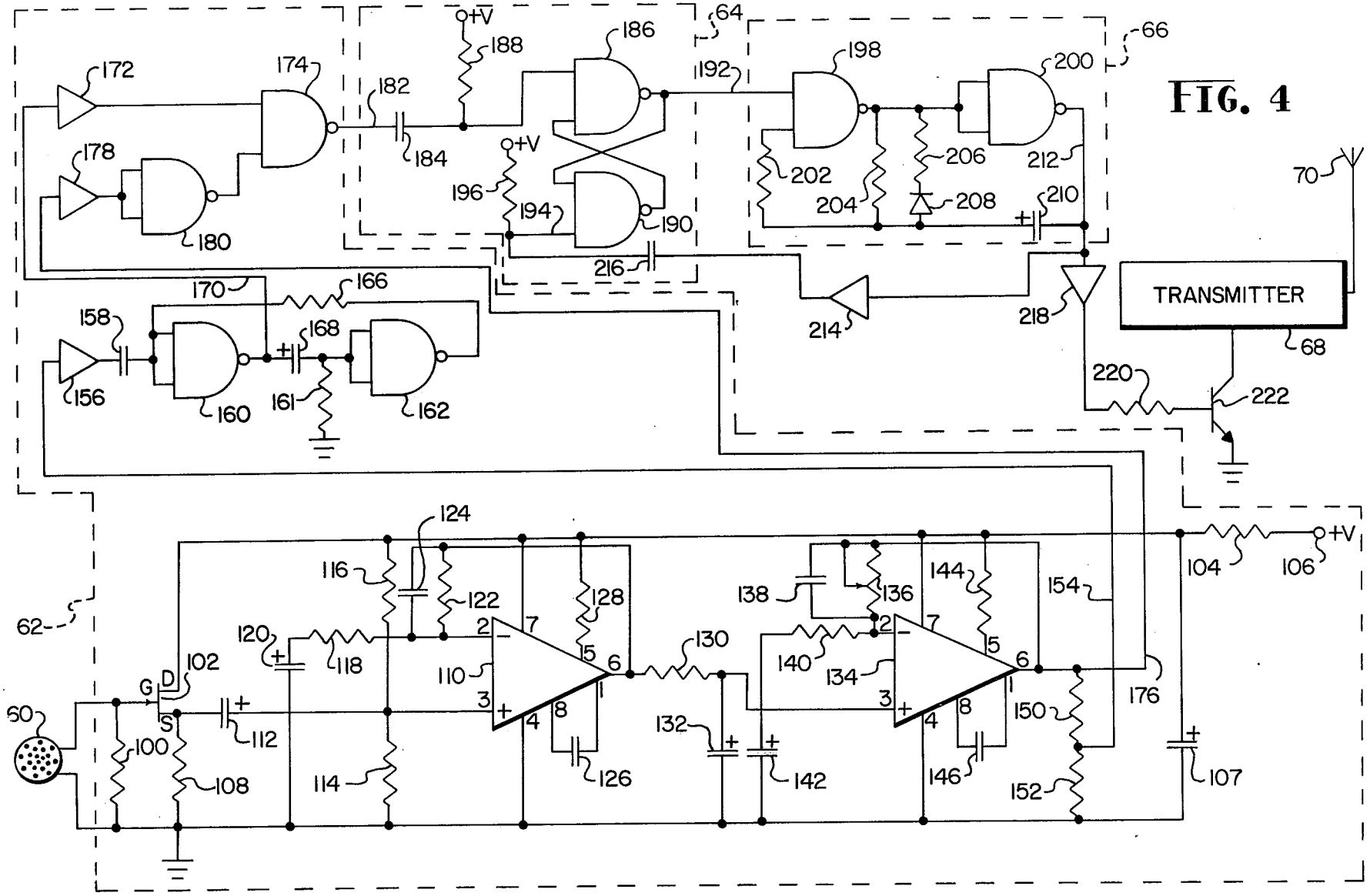
FIG. 4 depicts a detailed schematic diagram of illustrative circuitry implementing the sensing and transmitting portion of the block schematic diagram of FIG. 3.

Referring now to FIG. 4, wherein there is a detailed circuit diagram of illustrative circuitry within housing 42 which implements that portion of the block schematic of FIG. 3 enclosed by the dotted lines indicated to by the reference numeral 42. Transducer 60 is coupled across resistor 100 to the gate terminal of field effect transistor 102, illustratively a type 2N5248. The drain terminal of FET 102 is coupled through resistor 104 to positive supply terminal 106 with filtering being supplied by capacitor 107. The source terminal of FET 102 is coupled through resistor 108 to ground. Resistor 100 is chosen to have a very high resistance value, illustratively 10 megohms. The circuit configuration of resistor 100, FET 102 and resistor 108 functions as an impedance matcher for coupling transducer 60 to the input of comparator amplifier 110. This coupling is through capacitor 112 and resistor 114. Amplifier 110 is illustratively a type CA 3078 integrated circuit. Input terminal 3 of amplifier 110 is also coupled to positive voltage source terminal 106 through resistors 116 and 104. Input terminal 2 of amplifier 110 is connected to ground through resistor 118 and capacitor 120. The output terminal 6 of amplifier 110 is fed back to input terminal 2 through the parallel combination of resistor 122 and capacitor 124. Internal connections for frequency selectivity of amplifier 110 are made by connecting terminals 1 and 8 by means of capacitor 126 and by connecting terminal 5 to the positive voltage supply by means of resistor 128. The foregoing connections and the chosen component values provide a high gain (approximately 100) 0.5 hertz high pass filter stage. Resistor 130 and capacitor 132 coupled between output terminal 6 of amplifier 110 and input terminal 3 of amplifier 134 provide a five hertz low pass filter. Effectively then, the input to terminal 3 of amplifier 134 is a greatly amplified signal having a frequency spectrum of about 0.5 to 5 hertz, corresponding to water disturbance in pool 10 within that frequency band. This is the characteristic spectrum of signals created by a person in the pool and suppresses weather induced disturbances in the water or high frequency disturbances produced, for example, by passing vehicles or normal activities around the pool.

Amplifier 134, also a type CA 3078 integrated circuit, is connected similarly to amplifier 110 with its output terminal 6 fed back to input terminal 2 by means of the parallel combination of resistor 136 and capacitor 138. Input terminal 2 of amplifier 134 is coupled to ground through resistor 140 and capacitor 142. Terminal 5 of amplifier 134 is connected to the positive voltage supply by means of resistor 144 and terminals 1 and 8 of amplifier 134 are interconnected by means of capacitor 146. The chosen component values for the connections to amplifier 134 make that stage act as a broadband buffer amplifier having unity gain.

The output of amplifier 134 is coupled to a voltage divider comprising resistors 150 and 152. The junction between resistors 150 and 152 is connected via lead 154 to the input of a one-shot multivibrator comprising buffer amplifier 156, capacitor 158, NAND gates 160 and 162, resistors 164 and 166 and capacitor 168. All NAND gates are illustratively type 4011 integrated circuits. Buffer amplifier 156, and all the other one input one output buffer amplifiers to be hereinafter mentioned, is illustratively a type 4050 CMOS X buffer integrated circuit. Such an amplifier is a non-inverting high gain buffer amplifier whose output tracks the input but quickly switches voltage levels between ground and the supply voltage whenever the input voltage crosses a threshold value which is approximately half the supply voltage level. Thus, as the signal on lead 154 varies in an analog fashion, this is converted into a digital form at the output of buffer 156. The operation of the multivibrator circuitry is initiated when the varying signal on lead 154 goes below the threshold value of buffer 156, causing the output of buffer 156 to quickly switch from a high to a low potential. This is differentiated by capacitor 158 and applied to the input of NAND gate 160.

The output of NAND gate 160 on lead 170, which is the output of the one-shot multivibrator, is a 100 millisecond positive pulse, which is applied to the input of buffer 172, which transmits this pulse to one input of NAND gate 174. The other input of NAND gate 174 is coupled to the output of amplifier 134 on lead 176 through buffer 178 and NAND gate 180. Because of the action of the voltage divider comprising resistors 150 and 152, the signal level on lead 176 is always greater than the signal level on lead 154 so that when both signals are above the threshold of the buffer amplifiers and are decreasing, buffer amplifier 156 will provide a negative voltage signal at its output prior to buffer amplifier 178 providing such a negative going transition. The function of buffers 172 and 178 in combination with NAND gates 174 and 180 is to provide a filter effect. The output of NAND gate 174 will only go low if the signal on lead 176 goes below the threshold of buffer 178 before the expiration of the 100 millisecond pulse output of the one-shot multivibrator on lead 170. Upon the occurrence of such a condition, a negative pulse is applied to lead 182, which pulse is differentiated by capacitor 184 and applied to one input of NAND gate 186, which input is also connected to the positive voltage supply through resistor 188.

NAND gates 186 and 190 are cross coupled in a standard flip-flop, or latch, configuration. Thus, the negative pulse on lead 182 will cause lead 192 to go high and remain in that state until a negative pulse is applied to lead 194, the second input to NAND gate 190, which is coupled to the positive supply through resistor 196. Lead 192 is an enabling lead for transmitter control oscillator 66 which comprises NAND gates 198 and 200, resistors 202, 204 and 206, diode 208, illustratively a type 1N914, and capacitor 210. The component values are chosen so that the output of oscillator 66 on lead 212 is a pulse train that is high for 1 second and low for 30 seconds so long as the input on lead 192 is high. Lead 212 is coupled to buffer 214 so that whenever the signal level on head 212 goes low, a negative-going pulse is transmitted through capacitor 216 to reset the latch. This occurs at the end of the 1-second period of the oscillator. However, if the water disturbance is such that there is a continuity of pulses on lead 182, the latch will again be set and lead 192 will remain at a high level keeping oscillator 66 enabled. Buffer 218 is also connected to lead 212. The purpose of buffers 214 and 218 is to provide a high input impedance so that the circuit operation of oscillator 66 is not affected thereby. The output pulses from oscillator 66 are coupled through buffer 218 and resistor 220 to the base of transistor 222, illustratively a type 5T2222. During the one-second time period when the output of oscillator 66 is at a high level, transistor 222 is turned on, enabling transmitter 68. During the 30-second time interval when the output of oscillator 66 is low, transistor 222 is turned off, disabling transmitter 68. These time periods are chosen to satisfy regulations of the FCC relating to remote control devices.

Although the invention has been described in reference to a particular preferred embodiment thereof, many changes and modifications will become apparent to those skilled in the art in view of the foregoing description which is intended to be illustrative and not limiting of the invention defined in the appended claims.

What is claimed is:

1. Apparatus for monitoring a swimming pool comprising:

transducer means for converting ambient air pressure changes into electrical signals;

water displacement collector means positioned below the surface of the water in the pool and coupled to said transducer means for receiving water displacement information in said pool and transmitting said water displacement information to said transducer means, said water displacement collector means including a conduit having water of the pool in a lower portion thereof, and air in the portion of the conduit above the water, said portion with air being coupled to said transducer means and having sufficiently low air leakage to transmit, to the transducer means, air pressure changes resulting from motion of water in the lower portion having frequencies in the 0.5 Hz to 5 Hz range;

detector means coupled to said transducer means for providing an output signal when said transducer means electrical signals are within a selected frequency range; and utilization means for receiving and utilizing said output signal.

2. The apparatus of claim 1 wherein said utilization means includes:

transmitting means responsive to an enabling signal for transmitting a remote control signal;

enabling means responsive to said output signal from said detector means for generating said enabling signal; and alarm means remote from said transmitting means and responsive to said remote control signal for providing an alarm indication.

3. The apparatus of claim 2 wherein said enabling means includes means responsive to said output signal for generating said enabling signal in the form of a train of pulses.

4. The apparatus of claim 2 wherein said alarm means comprises:

an audible warning device; and remote control signal receiver means responsive to said remote control signal for activating said audible warning device.

5. The apparatus of claim 1 wherein said transducer means comprises a ceramic transducer.

6. The apparatus of claim 1 wherein said detector means comprises:

band pass filter means tuned to a frequency range of 0.5 to 5.0 hertz;

impedance matching means coupled between said transducer means and said band pass filter means; and filter means coupled to said band pass filter means for providing said output signal.

7. The apparatus of claim 1 wherein said conduit low air leakage equalizes slowly occurring pressure changes due to changes in pool water level and barometric pressure.

8. The apparatus of claim 1 wherein said detector means is responsive to transducer means electrical signals in the frequency range of about 0.5 hertz to about 5 hertz.

9. The apparatus of claim 1 wherein said water displacement collector means comprises a plurality of first openings separated by wall member and facing in different directions, each of said first openings being connected by a transition region to a respective smaller opening whereby the effect of water disturbances received at a first opening is amplified at the respective smaller opening.

10. The apparatus of claim 9 wherein said plurality of first openings are positioned about 18 inches to 30 inches below the surface of the water.

11. Apparatus for monitoring a swimming pool comprising;

transducer means for converting ambient pressure changes into electrical signals;

water displacement collector means positioned below the surface of the water in the pool and coupled to said transducer means for receiving water displacement information in said pool and transmitting said water displacement information to said transducer means;

detector means coupled to said transducer means for providing an output signal when said transducer means electrical signals are within a selected frequency range, said detector means including;

band pass filter means tuned to a frequency range of 0.5 to 5.0 hertz;

impedance matching means coupled between said transducer means and said band pass filter means; and filter means coupled to said band pass filter means for providing said output signal, including:

voltage divider means for providing an upper level signal and a lower level signal from said band pass filter means, means coupled to receive said lower level signal and responsive to said lower level signal going below a predetermined threshold value for providing a pulse of a predetermined time duration, and means coupled to receive said pulse and said upper level signal and responsive to said upper level signal going below said predetermined threshold value during the duration of said pulse for generating said output signal; and utilization means for receiving and utilizing said output signal.

* * * * *